US006497191B2

(12) United States Patent
Tomatsu

(10) Patent No.: US 6,497,191 B2
(45) Date of Patent: Dec. 24, 2002

(54) AWNING FOR A RECREATIONAL BOAT INCLUDING A SLIDING WINDOW

(76) Inventor: Seizou Tomatsu, 54-2, Harusato-cho 2 chome, Chikusa-ku, Nagoya-shi, Aichi-ken, 464-0038 (JP)

( * ) Notice: Subject to any disclaimer, the term of this patent is extended or adjusted under 35 U.S.C. 154(b) by 0 days.

(21) Appl. No.: 09/832,307

(22) Filed: Apr. 10, 2001

(65) Prior Publication Data

US 2002/0043204 A1 Apr. 18, 2002

(30) Foreign Application Priority Data

Oct. 18, 2000 (JP) ..... 2000-317556

(51) Int. Cl.[7] ..... B63B 17/00
(52) U.S. Cl. ..... 114/361
(58) Field of Search ..... 114/361; 296/96.21, 296/84.1, 96.13

(56) References Cited

U.S. PATENT DOCUMENTS 2,821,989 A 4/1958 Shepard
2,836,140 A * 5/1958 Hunt, Jr. ..... 114/361
4,926,782 A 5/1990 Lacy
6,293,616 B1 * 9/2001 Williams et al. ..... 296/203.01

* cited by examiner

*Primary Examiner*—Ed Swinehart
(74) *Attorney, Agent, or Firm*—Flynn, Thiel, Boutell & Tanis, P.C.

(57) ABSTRACT

The present invention provides an awning, which is excellent in the appearance and the opening and closing operation. Roof cover 3 having a light shielding effect is provided so as to hang down forward above open cabin 2 of cruiser C, transparent window panel 4 is provided and inclined to be in parallel with said roof cover 3, said window panel 4 is made to freely open and close by sliding in the space X between the front end of the roof cover 3 and the front portion of the open cabin at the front side of the roof cover, the opening and closing operability of the window panel 4 is made excellent, and in particular, when the window panel 4 is closed, the form becomes streamline in appearance in which the wind is directed to fall forward from the window panel 4 to the roof cover 3.

20 Claims, 14 Drawing Sheets

AWNING FOR A RECREATIONAL BOAT INCLUDING A SLIDING WINDOW

BACKGROUND OF THE INVENTION

1. Field of the Invention

The present invention relates to an awning to be fit to an open cabin of a cruiser or recreational boat whose upper side is open.

2. Description of the Related Art

Conventionally, there is a cruiser that has a main cabin with a steering which is open to the air, a cruiser that has a flying deck (called a flying bridge, also) with a steering which is provided on the roof of a main cabin, and a cruiser having a cabin whose upper side is open (hereinafter, such as cabin is referred to as an open cabin).

Since the upper side of such an open cabin is open, a steersman can enjoy a refreshing sense of freedom during steering.

However, when steering in such an open cabin, a steersman may be exposed to a strong head wind, sprayed by the waves, or exposed to sunlight, so an enclosure is installed in the open cabin in order to enclose the steering seat and protect the steersman.

There are various types of enclosures, and most of them are formed so that transparent vinyl sheets are spread via fasteners on the front face and both side faces of a main frame constructed in the form of a box on the open cabin, and a shielding sheet is spread on the top face of the main frame. Therefore, such an enclosure does not have a good external appearance since the box-shaped enclosure projects from the streamlined hull.

Furthermore, the enclosure is ventilated by opening the fasteners of the transparent vinyl sheets, however, the cruiser is typically anchored while being left exposed to rain at a marina, so that the transparent vinyl sheets may deform due to changes in temperature and other environmental conditions making smooth opening and closing of the fasteners difficult.

SUMMARY OF THE INVENTION

To solve the abovementioned problems such as a poor appearance of the enclosure and a difficulty in opening and closing the fasteners of the enclosure in the conventional art, in the present invention, a roof cover with a light shielding effect is provided so as to hang down toward the front side at the upper side of the open cabin of the cruiser, a transparent window panel is provided and inclined so as to be in parallel with said roof cover, said window panel is made to freely open and close by sliding in a space between the front end of the roof cover and the front portion of the open cabin that is provided at the front side of the roof cover, the opening and closing operability of the window panel is excellent, and in particular, when closing the window panel, the awning is made to have a streamlined form so that wind flows down forward from the window panel to the roof cover.

In short, according to the invention, since the roof cover 3 having a light shielding effect is disposed so as to hang down forward at the upper side of the open cabin 2, the roof cover is in good harmony with the streamlined cruiser C, and can be used as a roof with an excellent appearance in comparison with the conventional box-shaped enclosure.

In addition, air resistance against a head wind heading for the open cabin 2 is relieved by the inclination of the roof cover 3 to reduce the pitching and rolling of the cruiser C due to the head wind, whereby the steering is made excellent.

Since the space X between the front end of the roof cover 3 and the front portion of the open cabin 2 is freely opened and closed by sliding the transparent window panel 4 disposed and inclined so as to be in parallel with the roof cover 3, the space X can be opened and closed by the easy operation of sliding the window panel 4 in comparison with the conventional opening and closing means by means of fasteners that are troublesome to open and close, whereby, in the condition where the window panel 4 is opened, wind can be allowed to blow in the steering sheet of the open cabin 2, and a steersman can feel a refreshing sense of freedom.

Furthermore, in the condition where the window panel 4 is closed, the form becomes an excellent streamline in appearance in which inclination continues from the window panel 4 to the roof cover 3 in comparison with the conventional type, the field of view is good, and a strong head wind and the sea spray can be avoided, so that the cruiser C can be steered with no problem.

A pair of parallel rods 8 and 8*a* disposed in parallel at the right and left are provided on the lower ends of the side frames 12 and 12*a* supporting the roof cover 3, and the parallel rods 8 and 8*a* are connected via the attaching and detaching means 24, 24*a* . . . to the handrails C1 and C1*a* provided at the left and right of the open cabin 2, so that the awning 1 can be attached to the existing handrails C1 and C1*a* without providing and fixing an attaching member exclusive for the awning 1, and the attaching work becomes easy.

The awning can be easily removed from the open cabin 2 as necessary.

Moreover, since the rear end of the roof cover 3 is extended so as to cover the upper side of the rear deck C4, the shading area of the roof cover 3 can be expanded not only to the steering sheet but also to the extent up to the rear deck C4, and this roof cover 3 also shields the rear deck C4 from sunlight and rain. Therefore, the practical effect of the invention is great.

DETAILED DESCRIPTION OF THE DRAWINGS

The Foregoing and other features and advantages of the present invention will become more readily more appreciated as the same becomes better understood by reference to the following detailed description when taken into conjunction with the accompanying drawings wherein.

DETAILED DESCRIPTION OF THE PREFERRED EMBODIMENT

Figure 1:
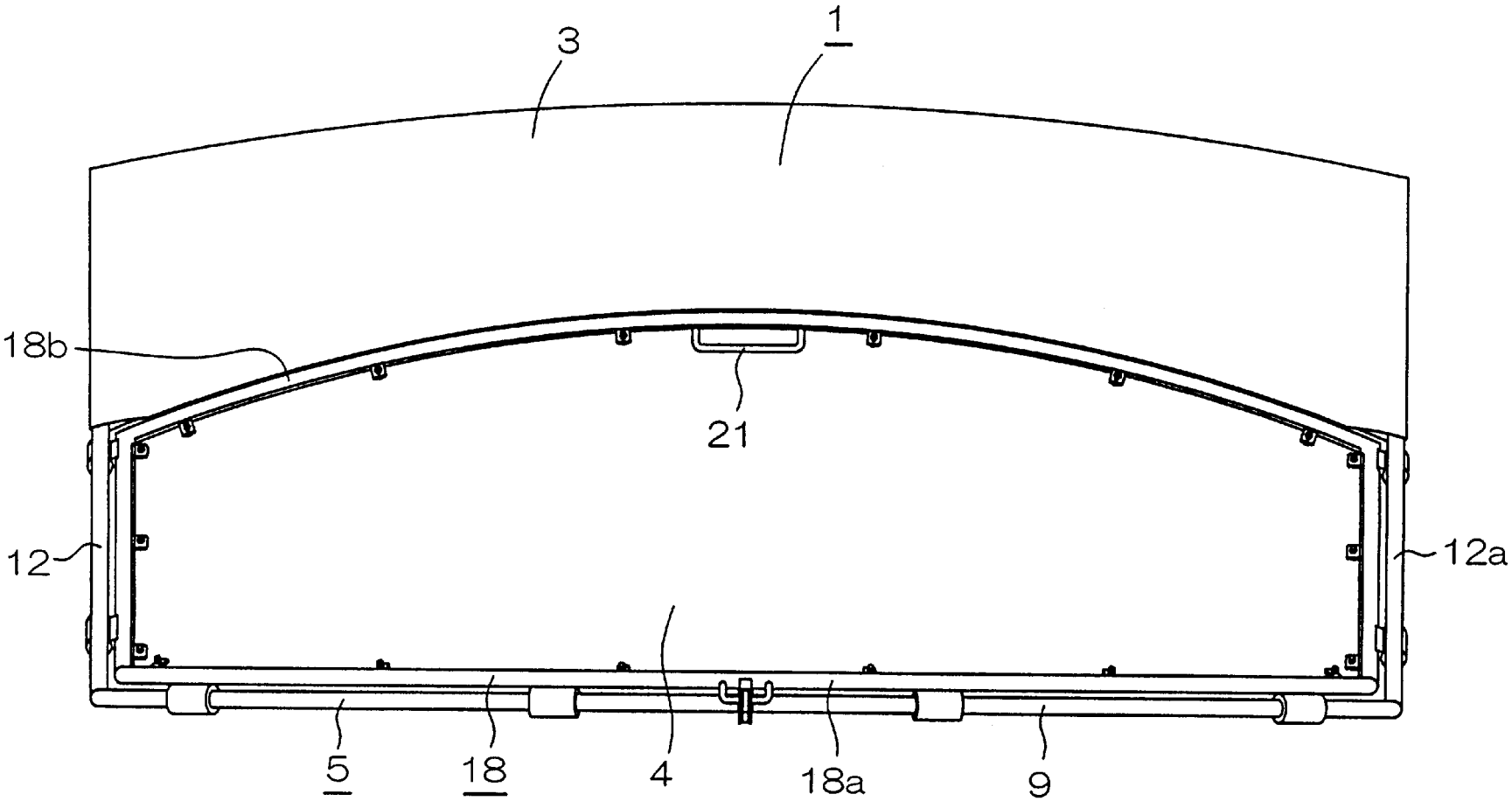
FIG. 1 is a front view of the awning in the condition where the window panel is closed.
Figure 2:
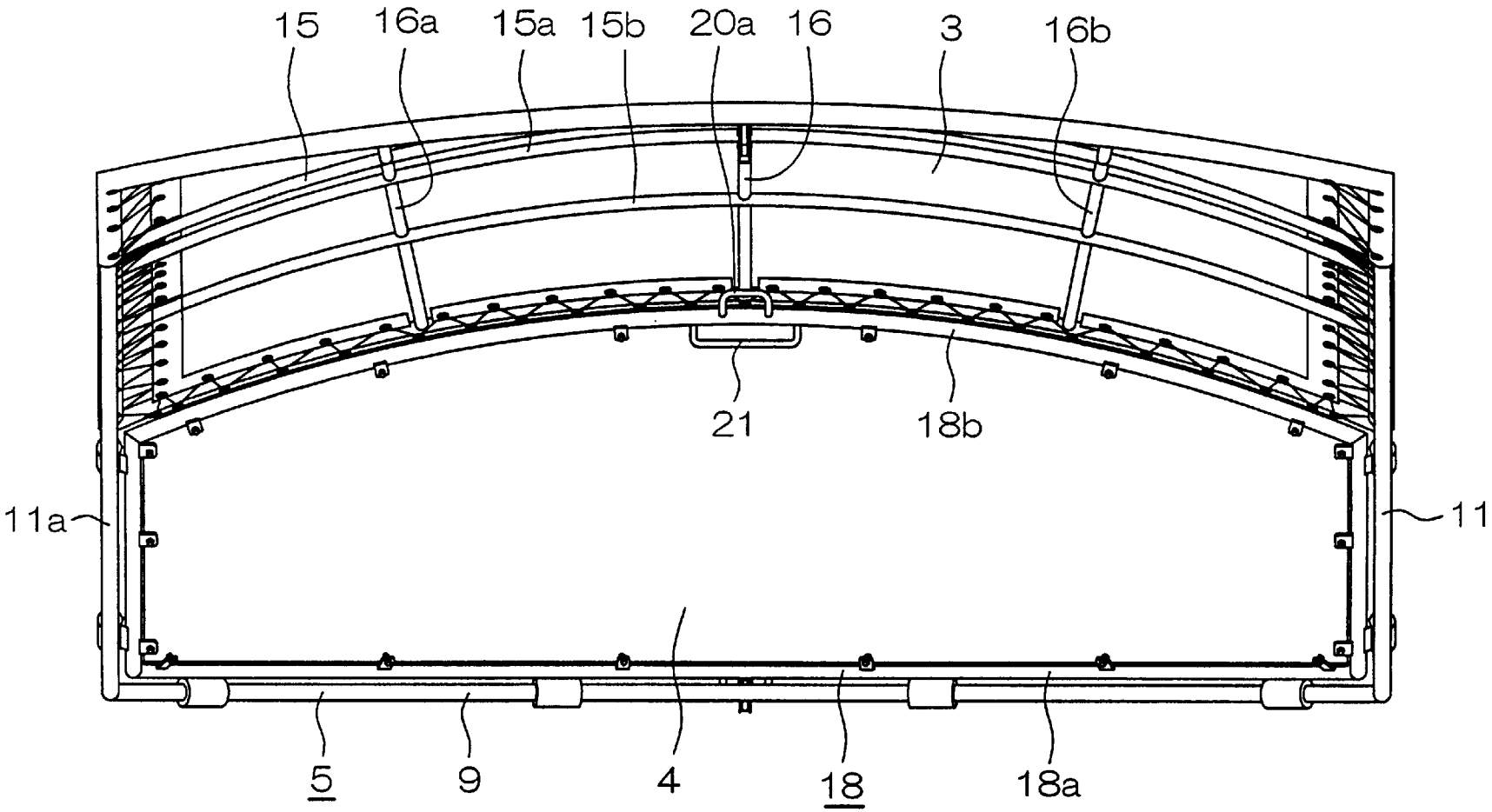
FIG. 2 is a rear view of FIG. 1.
Figure 3:
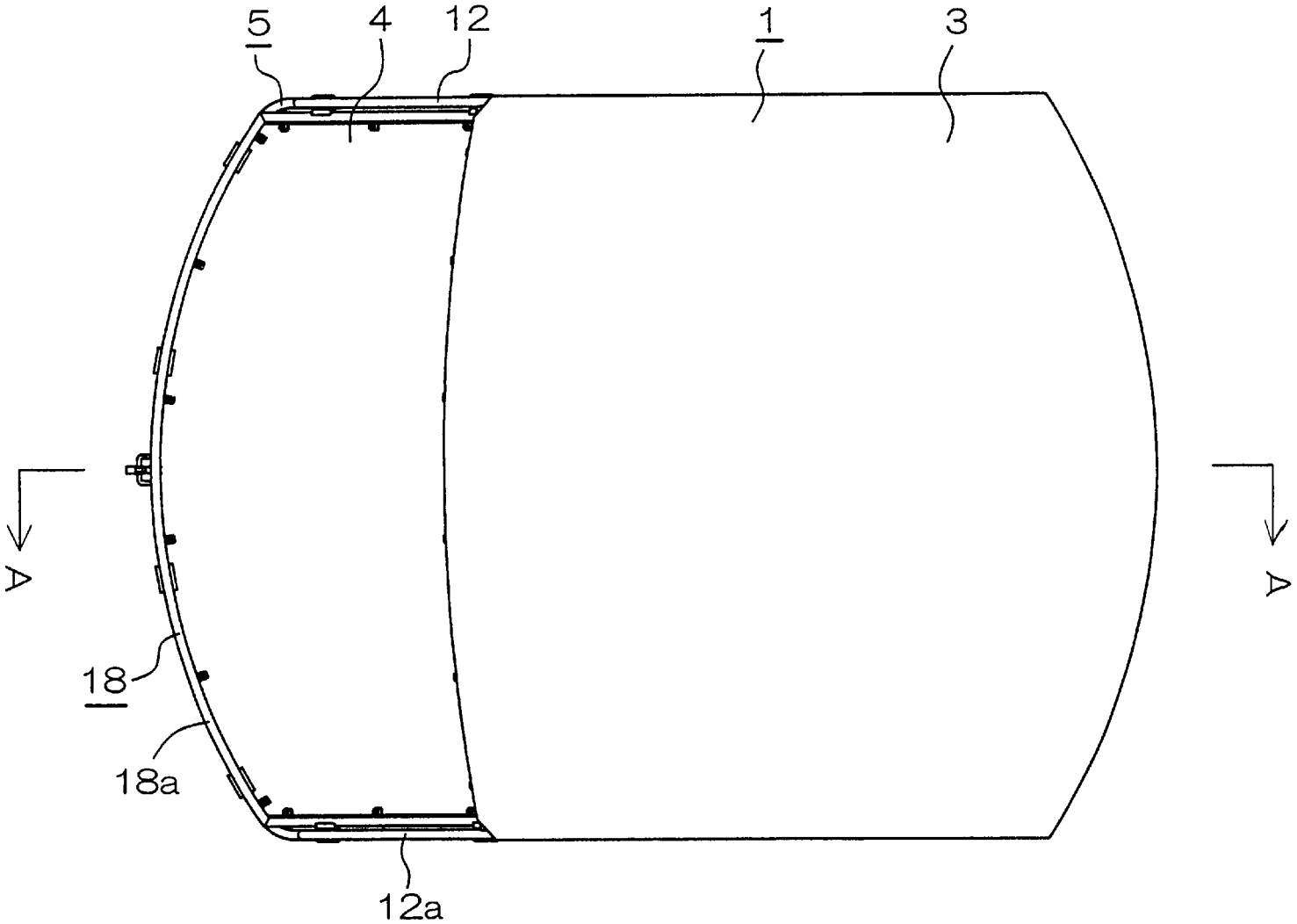
FIG. 3 is a plan view of FIG. 1.

Hereinafter, an embodiment of the invention shall be described based on the drawings.

Awning 1 of the present invention is mainly comprised of a sheet-shaped waterproof roof cover 3 having a light shielding effect, which is disposed above open cabin 2 of cruiser C so as to angle downwardly as same projects forwardly, and transparent window panel 4 which moves between open and closed positions by sliding in space X between the front end of said roof cover 3 and the front portion of open cabin 2, and is disposed and inclined so as to be in parallel with the roof cover 3.

Also, the cruiser C in the drawing is a type provided with a flying deck (open cabin 2) on the roof of the main cabin, and, needless to say, in addition to this type of cruiser C, the awning 1 of the invention can be applied to other cruisers if they have open cabins without roofs.

The abovementioned roof cover 3 and window panel 4 are attached to mainframe 5.

Figure 4:
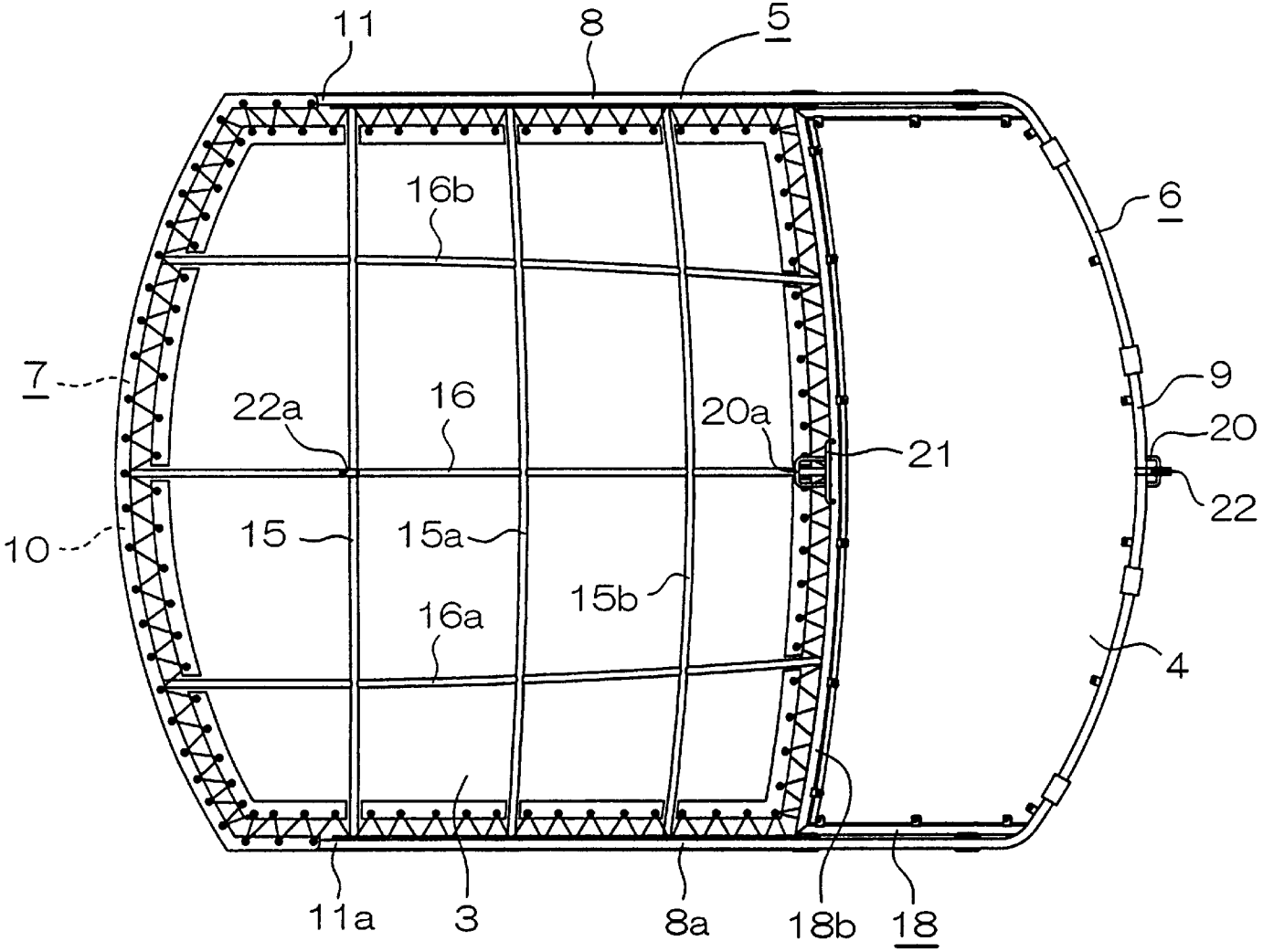
FIG. 4 is a bottom view of FIG. 1.

The mainframe 5 is formed by monolithically molding front frame 6 and rear frame 7, and as shown in FIG. 4, the mainframe is formed into a roughly lateral rectangular shape so that the frame is bilaterally symmetric and the front and rear sides curve outward in the bottom view.

The front frame 6 is formed into a roughly U shape by connecting parallel rods 8 and 8*a,* which are disposed in parallel at the right and left sides on the same plane, and front arc rod 9, which curves outward from the front end of said parallel rods 8 and 8*a.*

Figure 5:
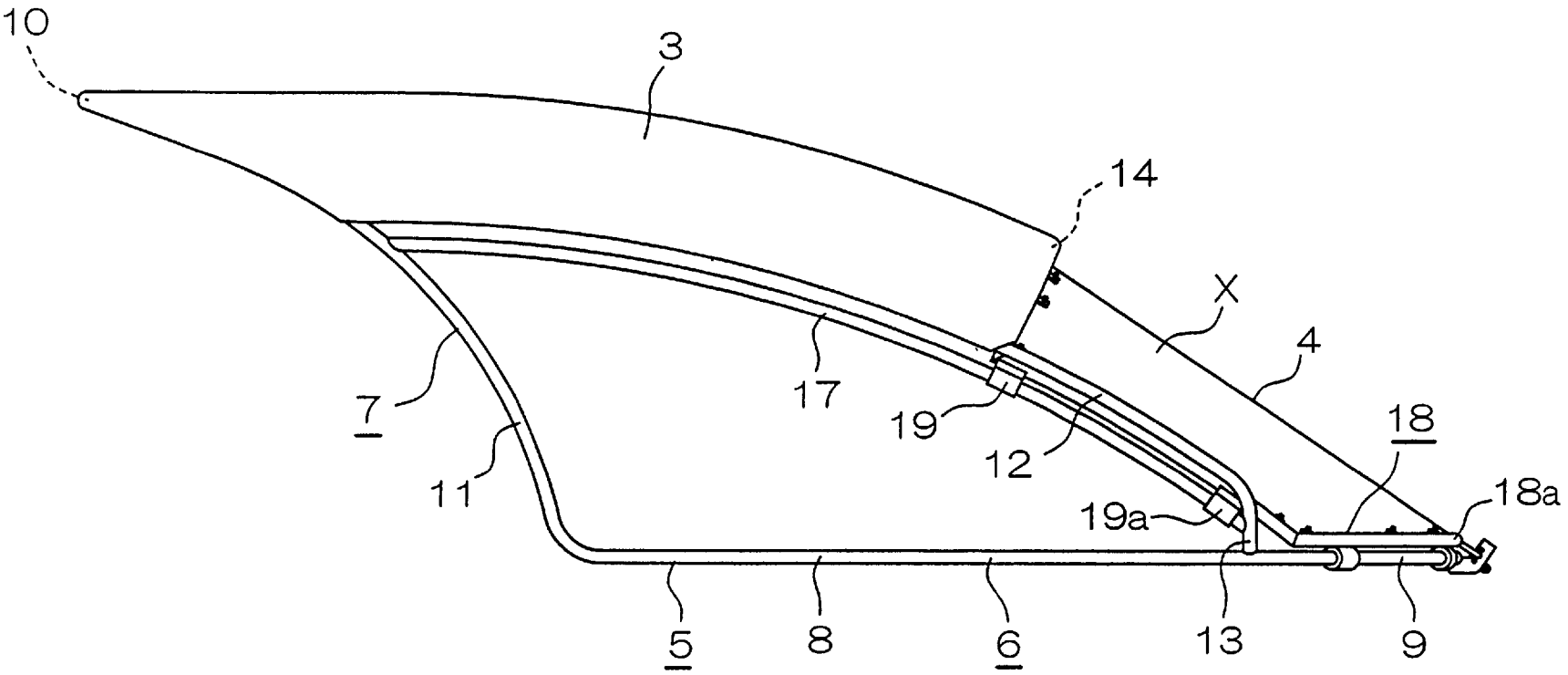
FIG. 5 is a side view of FIG. 1.

The rear ends of the parallel rods 8 and 8*a* are continued from bow-shaped rods 11 and 11*a* that are arched so as to project forwardly as shown in FIG. 5, and the lower ends of said bow-shaped rods 11 and 11*a* are connected to the rear ends of the parallel rods 8 and 8*a* at almost right angles, whereby these frames and rods are united to form the mainframe 5.

Figure 6:
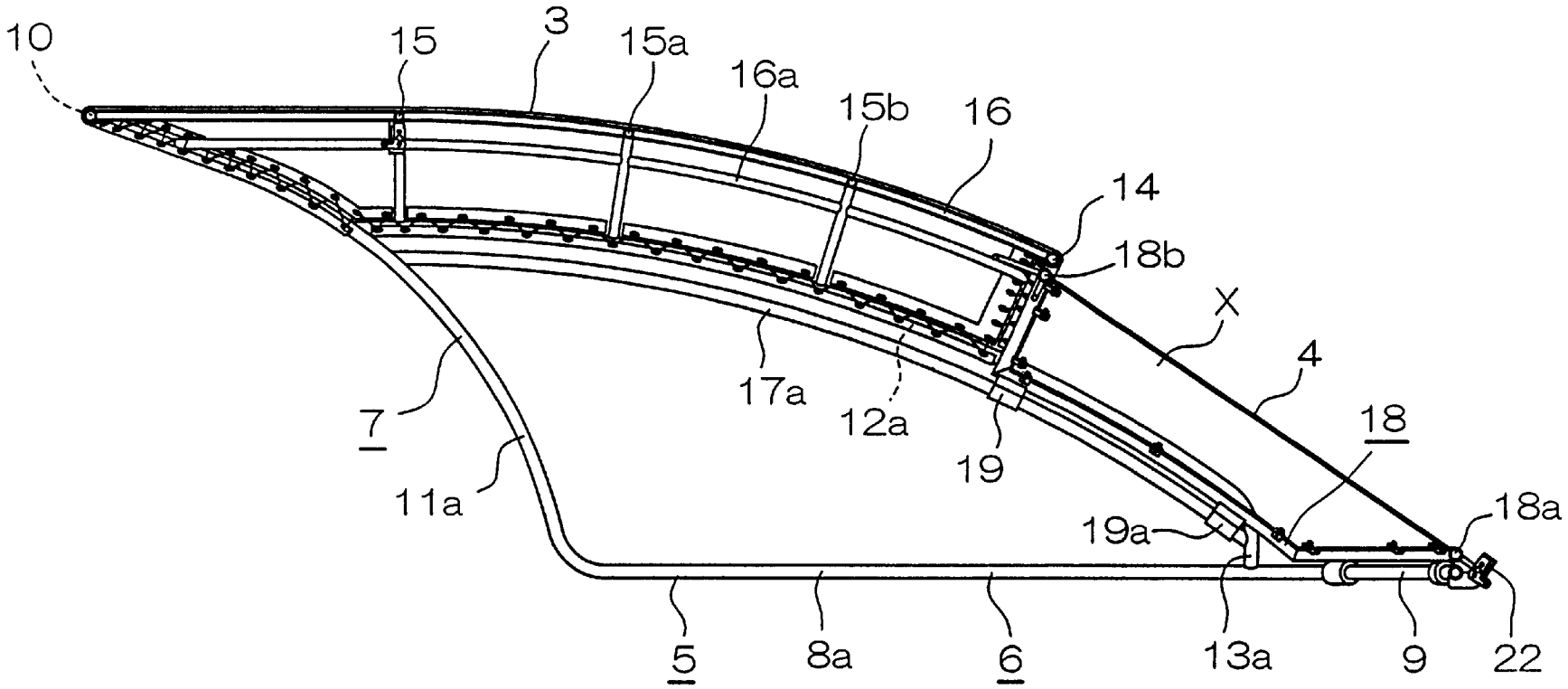
FIG. 6 is a sectional view along the A—A line of FIG. 3.
Figure 7:
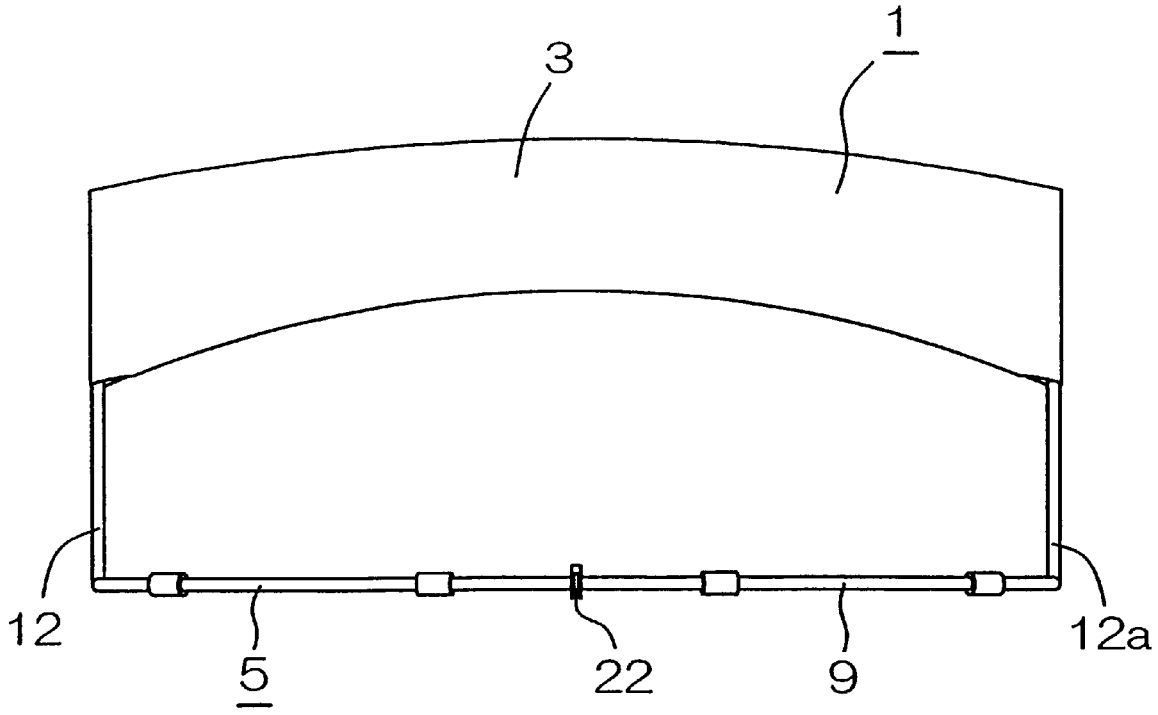
FIG. 7 is a front view of the awning in the condition where the window panel is opened.

Furthermore, as shown in FIG. 6, in the mainframe 5, arched side frames 12 and 12*a* which gently curve are laid across the front ends of the parallel rods 8 and 8*a* and the rear portions of the bow-shaped rods 11 and 11*a,* and said side frames 12 and 12*a* are disposed in parallel with each other so as to overlap with the parallel rods 8 and 8*a* and the bow-shaped rods 11 and 11*a.*

At the front ends of the side frames 12 and 12*a,* the connecting portions to the parallel rods 8 and 8*a* form short standing portions 13 and 13*a.*

At the forward portions of the side frames 12 and 12*a,* the arch-shaped front frame 14 is laid.

A plurality of lateral supporting rods 15, 15*a* and 15*b* of the roof cover 3 with the same curvature as that of the front frame 14 are disposed in parallel with each other between the front frame 14 and the rear arc rod 10, supporting rods 16, 16*a* and 16*b* are disposed so as to intersect said lateral supporting rods 15, 15*a* and 15*b,* and the front and rear ends of said supporting rods 16, 16*a* and 16*b* are connected to the front frame 14 and rear arc rod 10, respectively.

Herein, the roof cover 3 is spread over the curved surface surrounded by the rear arc rod 10, front frame 14, and side frames 12 and 12*a.*

That is, each side of the roof cover 3 is turned up so as to wrap the rear arc rod 10, front frame 14, and side frames 12 and 12*a,* and as shown in FIG. 4, a lining spread on the back surface of the roof cover 3 and the abovementioned sides of the cover are stitched up by a string in zigzags.

Figure 13:
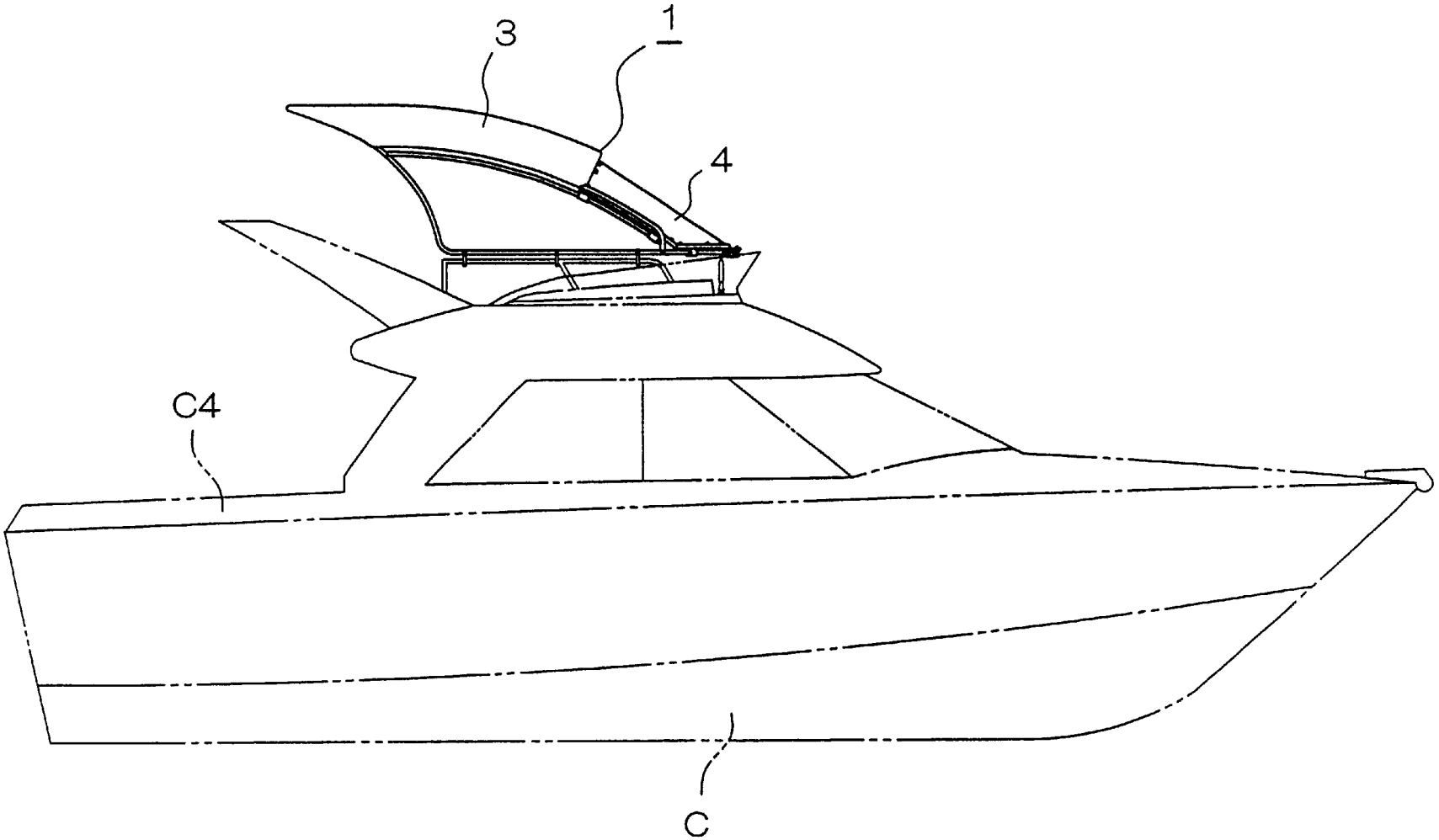
FIG. 13 is a side view of FIG. 12.
Figure 14:
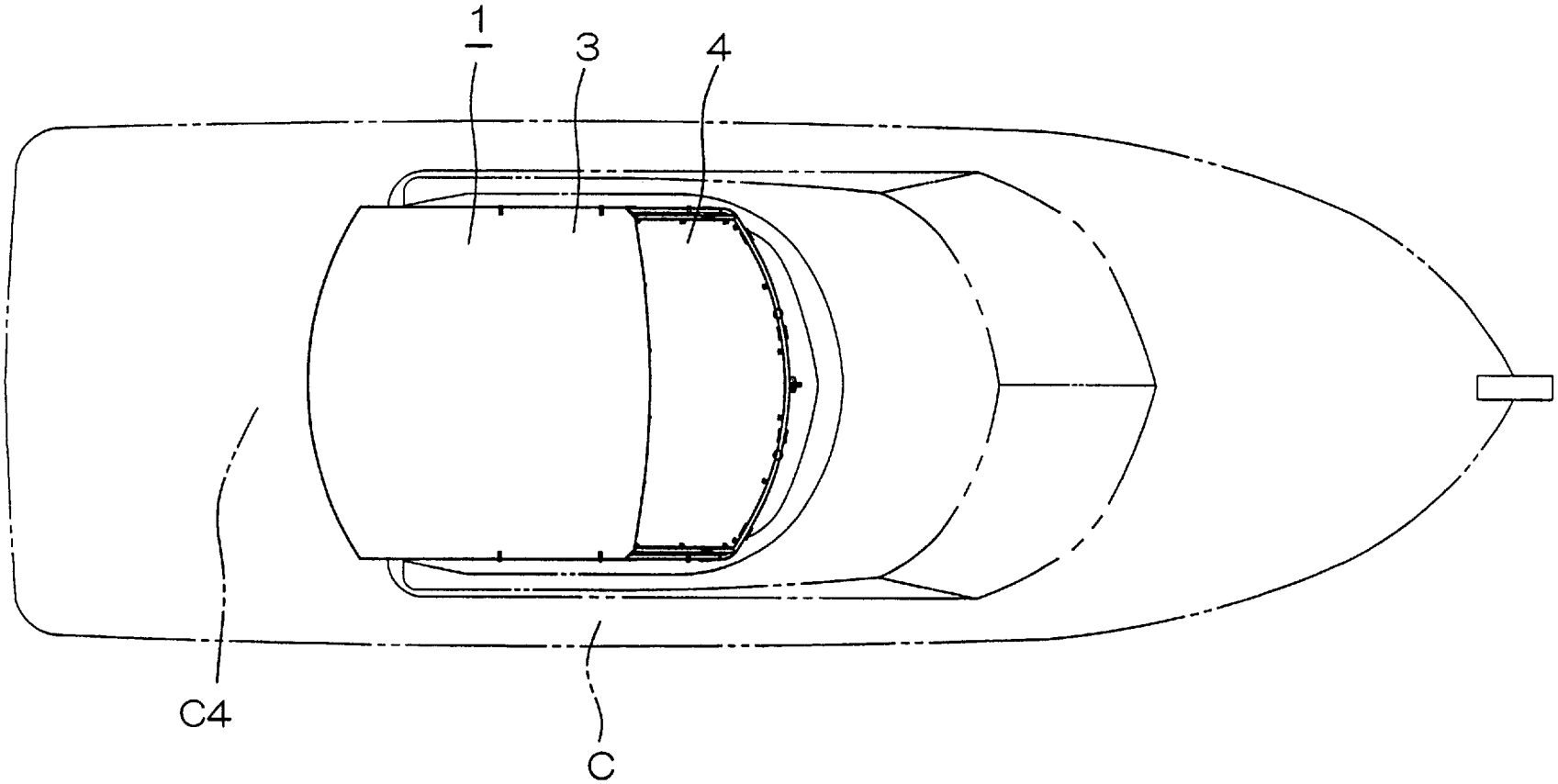
FIG. 14 is a plan view of FIG. 12.

Then, as shown in FIG. 13, this roof cover 3 is formed by extending the rear end of the roof cover 3 so as to cover the rear deck C4 of the cruiser C in the condition where the awning 1 is attached to the cruiser C.

Furthermore, as shown in FIG. 5, slide rails 17 and 17*a* are provided in parallel with each other under the side frames 12 and 12*a* to follow the curves of the frames, and the front and rear ends of said slide rails 17 and 17*a* are connected to the rear portions of the standing portions 13 and 13*a* of the slide frames 12 and 12*a* and the arc rods 11 and 11*a,* respectively.

The window panel 4 is made from plastic such as polycarbonate, has an area roughly corresponding to the space X surrounded by the front frame 14, front arc rod 9, and side frames 12 and 12*a,* and is bent horizontally into an arch shape as the front frame 14.

Reinforcing frame 18 is provided on the periphery of the window panel 4, and cylindrical sliders 19 and 19*a* are fixed to the front and rear ends at the right and left sides of said reinforcing frame 18, and said sliders 19 and 19*a* are slidably mounted on the slide rails 17 and 17*a,* whereby the window panel 4 opens and closes by sliding in the space X between the front frame 14 and the front arc rod 9 (corresponding to the space X between the front end of the roof cover 3 and the front portion of the open cabin 2).

Figure 8:
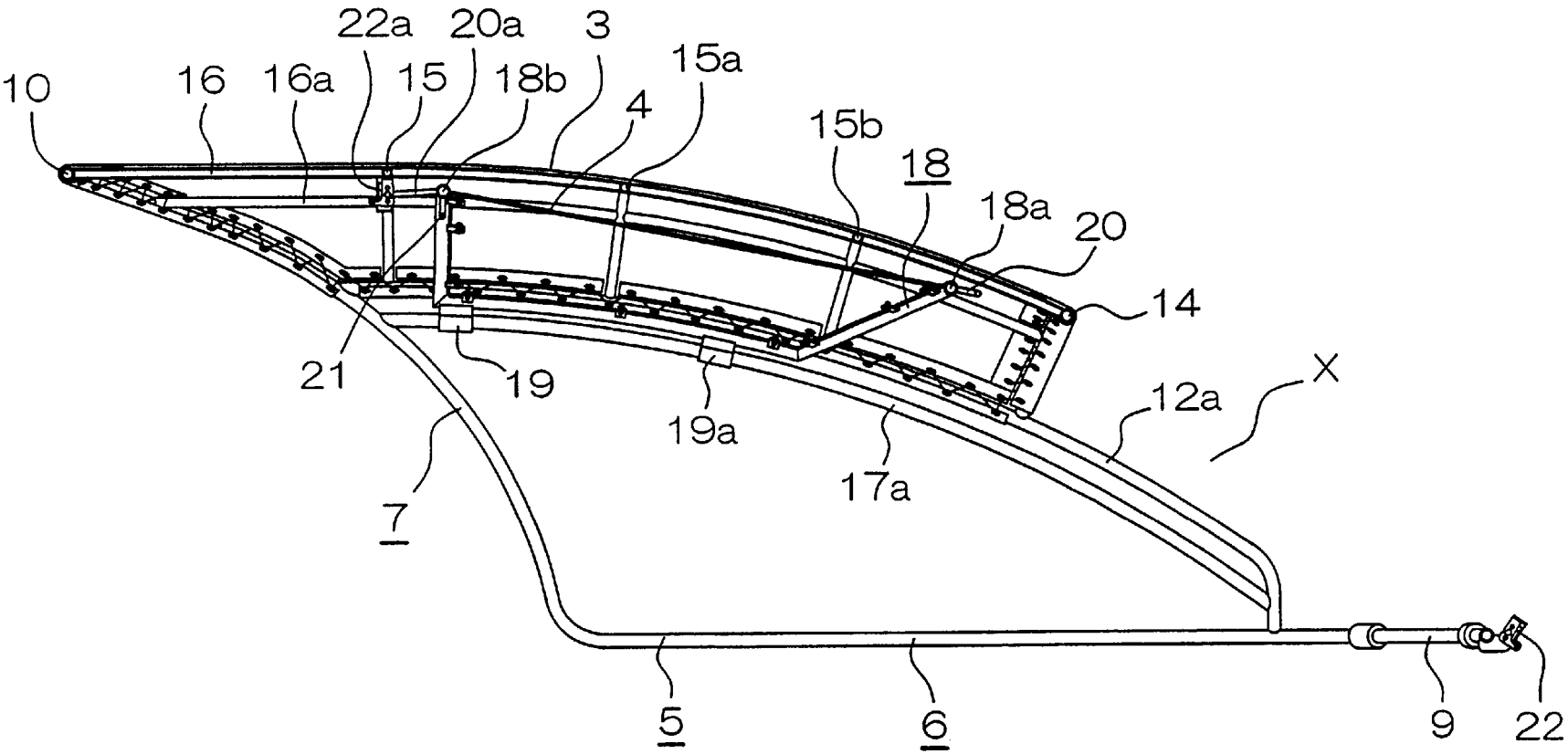
FIG. 8 is a sectional view similar to FIG. 6 of the awning in the condition where the window panel is opened.

In other words, the front side 18*a* and rear side 18*b* of the reinforcing frame 18 are disposed so as to overlap with the upper portion of the front arc rod 9 and the lower portion of the front frame 14, respectively, in the condition where the space X is closed by the window panel 4 as shown in FIG. 6, and on the other hand, the window panel 4 is disposed so as to overlap the lower portion of the roof cover 3 in parallel in the condition where the space X is opened by sliding the window panel 4 rearward as shown in FIG. 8.

U-shaped rear strikers 20 and 20*a* are provided at the middle portions of the front side 18*a* and rear side 18*b* of the reinforcing frame 18 corresponding to the lower edge and upper edge of the window panel 4 so that the strikers project forward and rearward in the direction of inclination of the window panel 4.

U-shaped knob 21 for sliding operation of the window panel 4 is hung down from the middle portion of the rear side 18*b* of the reinforcing frame 18.

In addition, the portion of the front arc rod 9 corresponding to the front striker 20 is provided with locking device 22 for locking and unlocking said striker 20.

The portion of the rod corresponding to the rear striker 20*a* in the condition where the window panel 4 is moved rearward (corresponding to the intersection between the lateral supporting rod 15 and vertical supporting rod 16) is provided with locking device 22*a* for locking and unlocking the striker 20*a.*

Figure 10:
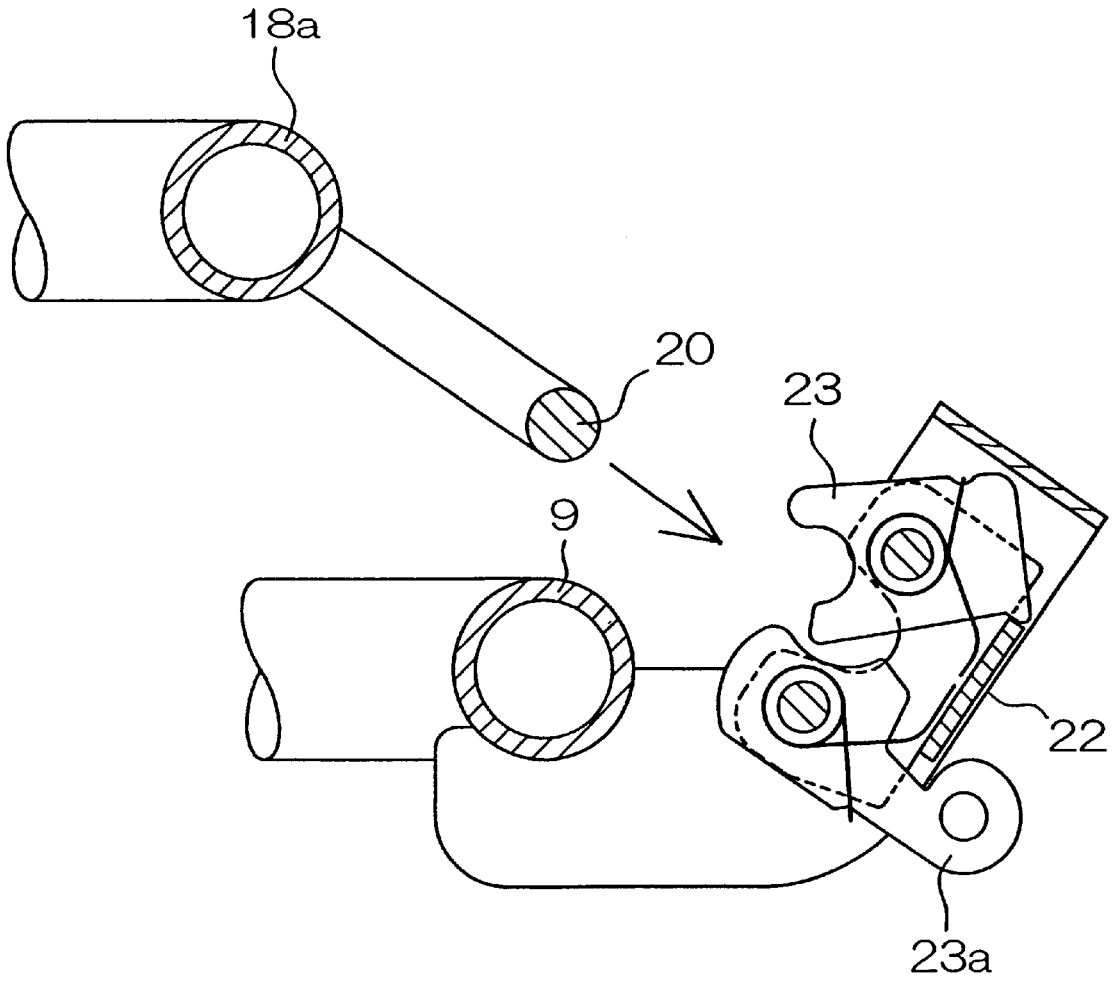
FIG. 10 is an enlarged sectional view showing the striker and the locking device.

The locking devices 22 and 22*a* have the same structure, and as the schematic internal structure of one locking device 22 shown in FIG. 10, the locking device is comprised of latch 23 for attaching and detaching the strikers 20 and 20*a* and lever 23*a* for attaching and detaching operations of the strikers 20 and 20*a* with said latch 23.

The latch 23 is forked so as to retain the strikers 20 and 20*a,* provided in a manner enabling the latch to freely rotate, and pressed in the direction of releasing the strikers 20 and 20*a* by a twist coil spring. On the other hand, the lever 23*a* is provided so that the front end is freely engaged and disengaged with one of the abovementioned forks, and pressed in the direction of engaging with the fork of the latch 23 by a twist coil spring.

When the latch 23 rotates while retaining the striker 20 or 20*a* between the forks, one of the forks engages the front end of the lever 23*a,* the locking devices 22 and 22*a* retains the strikers 20 and 20*a,* and in this condition, the base end of the lever 23*a* is swung so as to disengage the fork, whereby the latch 23 rotates in the releasing direction by the pressing force of the twist coil spring to release the strikers 20 and 20*a* from the locking devices 22 and 22*a*.

Figure 9:
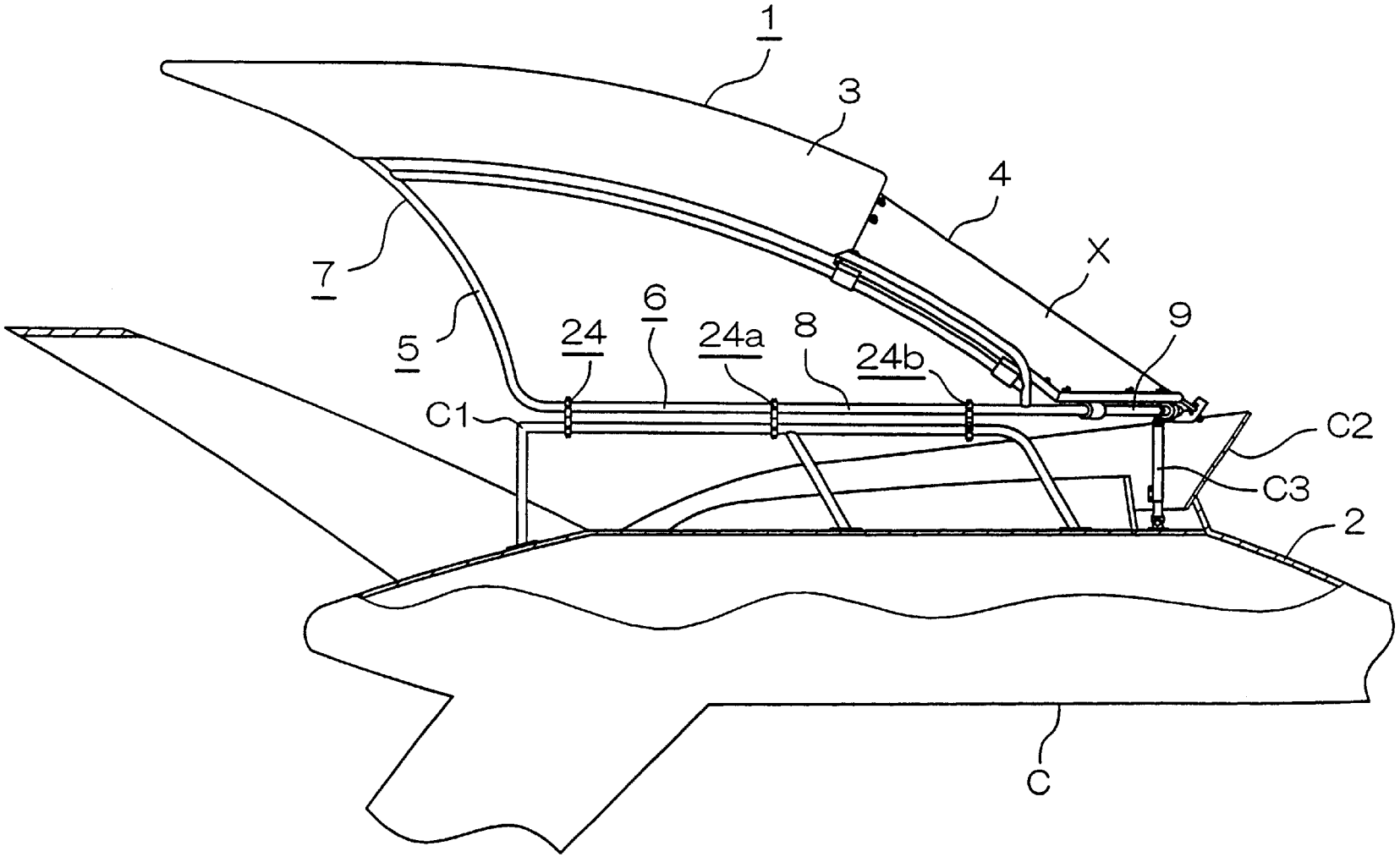
FIG. 9 is a partial side view showing the attached condition of the awning.

Also, as shown in FIG. 9, the existing bar-shaped handrails C1 and C1*a* are fixed to the right and left edges of the open cabin 2 of the cruiser C in a horizontal manner with respect to the open cabin 2, and awning 1 is connected to the handrails C1 and C1*a* via attaching and detaching means 24, 24*a* and 24*b* comprised of clamps.

Concretely, parallel rods 8 and 8*a* on the mainframe 5 that are provided at a space corresponding to the space between the handrails C1 and C1*a* are disposed in parallel with each other by the clamps 24, 24*a* and 24*b* so as to overlap the handrails C1 and C1*a*.

Figure 11:
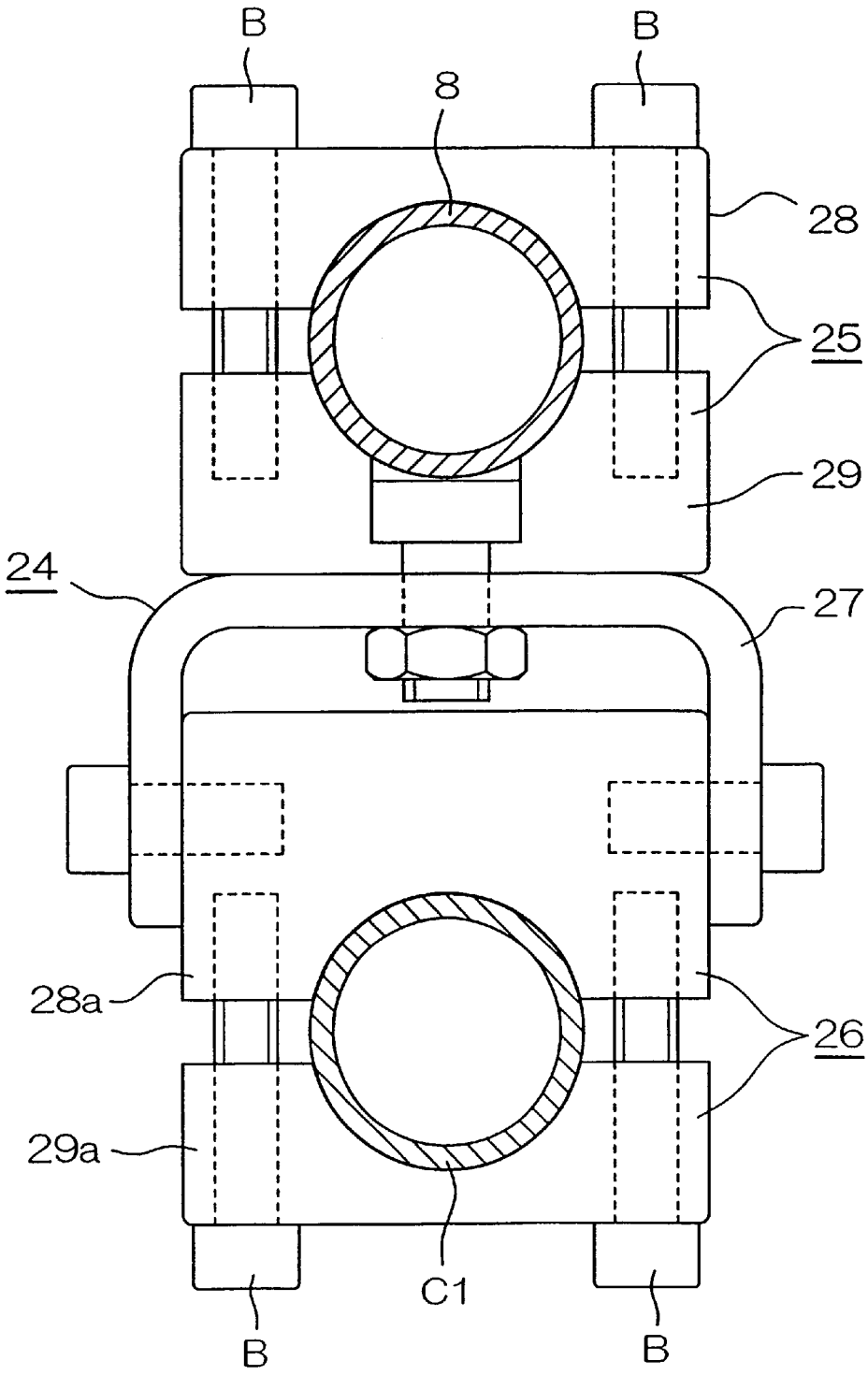
FIG. 11 is an enlarged front view showing the connected condition achieved by means of clamps.
Figure 12:
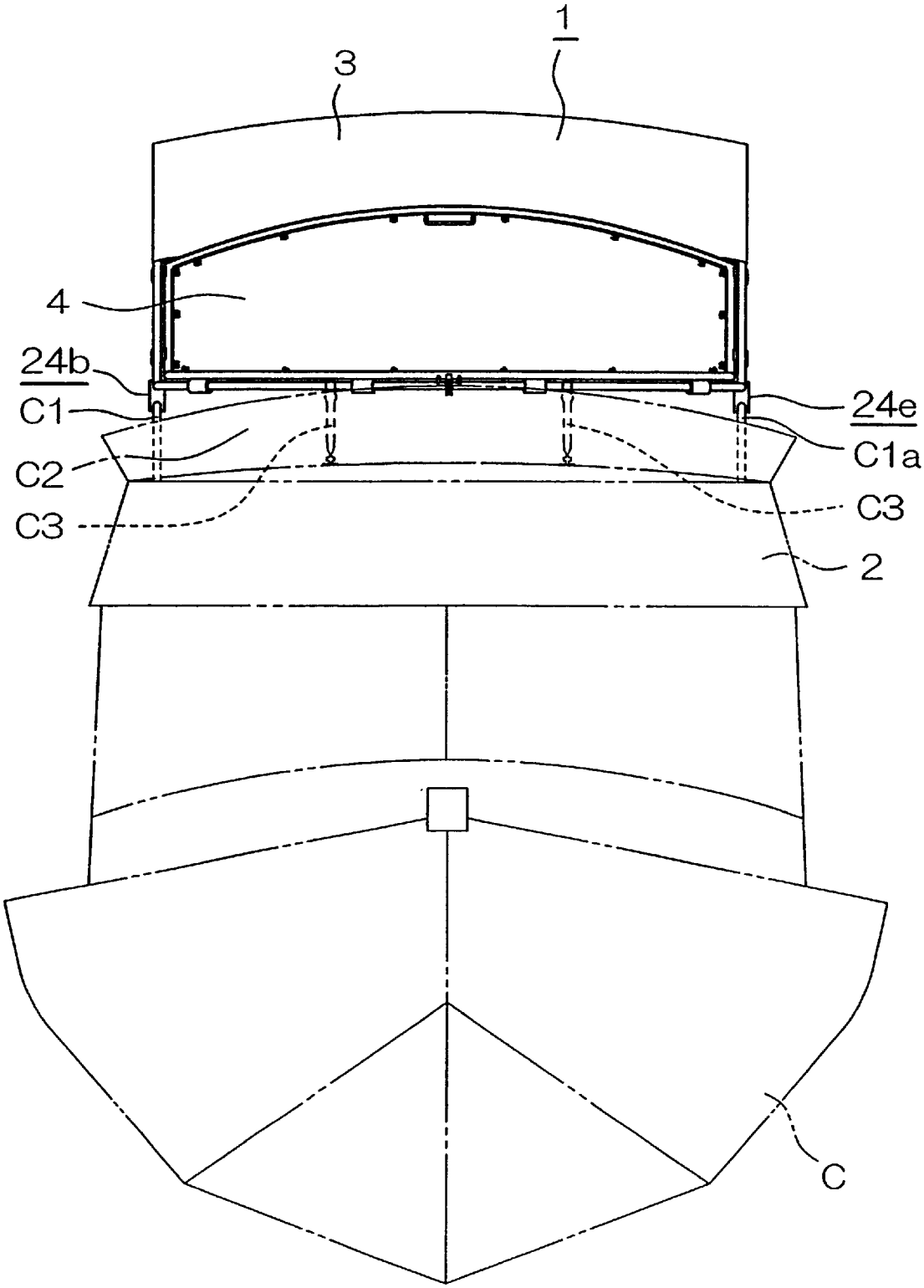
FIG. 12 is a front view showing the awning in use.

As shown in FIG. 11, the clamps 24, 24*a* and 24*b* connect the upper clamp 25 clamping the parallel rod 8 or 8*a* and lower clamp 26 clamping handrail C1 or C1*a* via U-shaped joint 27.

The upper clamp 25 and lower clamp 26 have almost the same structure and are formed of upper plates 28 and 28*a* and lower plates 29 and 29*a* in pairs, respectively, and in the lower surfaces of the upper plates 28 and 28*a* and the upper surfaces of the lower plates 29 and 29*a,* semicircular concave portions corresponding to the arcs of the parallel rods 8 and 8*a* or the handrails C1 and C1*a* are made, respectively, and female screws that communicate both ends of the upper plates 28 and 28*a* and lower plates 29 and 29*a* are threaded.

Then, the parallel rods 8 and 8*a* and handrails C1 and C1*a* are disposed between the concave portions of the upper plates 28 and 28*a* and lower plates 29 and 29*a* of the upper clamp 25 and lower clamp 26, and bolts B are screwed into the female screws in the upper plates 28 and 28*a* and the lower plates 29 and 29*a,* whereby the parallel rods 8 and 8*a* and handrails C1 and C1*a* are clamped by the upper clamp 25 and lower clamp 26 to connect the parallel rods 8 and 8*a* and the handrails C1 and C1*a*.

Thereby, as shown in FIG. 9, the awning 1 is fixed to the open cabin 2, and in the condition where the window panel 4 is closed, the space X is closed by the front face upper edge of windproof panel C2 provided on the periphery of the open cabin 2 and the front end of the roof cover 3.

Furthermore, at the front side of the open cabin 2, strut C3 that connects and supports the front arc rod 9 on the main frame 5 is erected.

Depending on the type of the cruiser C, the cruiser may not have the existing handrails C1 and C1*a,* and in this case, the strut C3 is erected around the open cabin 2 to connect and support the front arc rod 9 and the parallel rods 8 and 8*a* on the main frame 5.

Next, the operation of the awning 1 of the present invention is explained.

When windproofing is not necessary, handle 21 attached to the window panel 4 is gripped, the window panel 4 is slid rearward until the rear striker 20*a* attached to the window panel 4 (reinforcing frame 18) is locked by the rear lock device 22*a,* and the space X between the front end of the roof cover 3 and the front part of the open cabin 2 (the front face upper edge of the windproof panel C2) is opened.

Since the roof cover 3 is extended so that the rear end covers the upper side of the rear deck C4 of the cruiser C, the area including the steering sheet of the open cabin 2 up to the deck C4 is shaded.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An awning for a recreational boat having an open steering area, said awning comprising:

a light-shielding roof positionable above the steering area so that said roof angles downwardly as same projects forwardly;

a pair of laterally-spaced and elongate slide rails respectively disposed on opposite sides of said roof; and a transparent window panel and a reinforcing frame disposed along a periphery thereof, said reinforcing frame having a pair of laterally-spaced sides respectively mounting thereon cylindrical connectors disposed about and slidingly engaged with the respective slide rails to permit said window panel to slide relative to and along the respective slide rails between an open position and a closed position, said window panel in said closed position projecting forwardly from a front end of said roof and angling downwardly therefrom so as to be inclined and oriented in a generally parallel manner with said roof.

2. The awning of claim 1 including a frame having a pair of lower rods disposed on opposite sides of said roof and generally below the respective slide rails, said lower rods being configured for removable attachment to the boat on opposite sides of the open steering area.

3. The awning of claim 2 wherein said frame includes a pair of generally upright rear rods which project upwardly from respective rear ends of said lower rods and support a rear edge portion of said roof, said rear rods projecting rearwardly as same project upwardly such that said roof projects rearwardly and covers at least a portion of a rear deck of the boat.

4. The awning of claim 2 wherein said frame includes a front rod which extends transversely between forward ends of said lower rods and is positioned adjacent a lower edge of said window panel when same is in the closed position, a pair of generally upright rear rods which project upwardly from respective rear ends of said lower rods, and a pair of side rods having rear ends which are fixed to respective upper end portions of said rear rods and front ends which are fixed to the respective lower rods rearwardly from said front rod such that said side rods angle downwardly as same project forwardly from said rear ends thereof.

5. The awning of claim 4 wherein each of said rear rods has a configuration when viewed from the side which curves rearwardly as same projects upwardly such that lowermost ends of said rear rods are disposed closer to said front rod than uppermost ends of said rear rods.

6. The awning of claim 4 wherein said slide rails are disposed below the respective side rods on opposite sides of said frame, each said slide rail extending between a said rear rod and a generally vertically oriented lower end portion of said front end of a said side rod, a lowermost terminal end of each said lower end portion being fixed to the respective said lower rod.

7. The awning of claim 6 wherein said frame includes a rearmost rod extending transversely between upper ends of the respective rear rods, said rearmost rod, said front rod, and said lower rods all being generally horizontally oriented.

8. The awning of claim 7 wherein said frame includes a cross rod extending transversely between said side rods adjacent an upper edge of said window panel when in the closed position, said cross rod being disposed forwardly of said rearmost rod and rearwardly of said front rod, a plurality of transverse rods extending between and interconnecting the respective side rods, said transverse rods being disposed between said cross rod and said rearmost rod in a spaced-apart manner with one another, and a plurality of longitudinal rods extending between and interconnecting said cross rod and said rearmost rod, said longitudinal rods being disposed in intersecting relation with said transverse rods and being spaced from one another such that said transverse and longitudinal rods along with said rearmost and said cross rods define an open and grid-like support frame to which said roof is attached.

9. The awning of claim 8 wherein said support frame supports said roof so that same is bowed upwardly.

10. The awning of claim 1 wherein said slide rails are disposed such that said window panel and said reinforcing frame thereof are disposed beneath and in overlapping relation with said roof in the closed position.

11. A combination recreational boat and awning assembly therefor, said combination comprising:

a boat having an open steering area;

an awning assembly disposed above said open steering area so as to shield a driver from the elements while operating said boat, said awning assembly including a rigid unitary frame having upper and lower interconnected frame members, a roof panel supported on said frame, and a window arrangement supported on said frame forwardly of said roof panel so as to be slidably movable along said upper frame members relative to said roof panel between open and closed positions; and a mounting arrangement removably attaching said lower frame member to said boat adjacent said open steering area so that said awning assembly substantially covers same.

12. The combination of claim 11 wherein said mounting arrangement includes a handrail extending along at least a portion of said open steering area of said boat, and clamps which removably attach said lower frame member to said handrail to mount said awning assembly to said boat.

13. The combination of claim 11 wherein said mounting arrangement includes a plurality of struts which removably attach said lower frame member to said boat adjacent said open steering area to mount said awning assembly to said boat.

14. The combination of claim 11 wherein said frame includes a pair of said lower frame members which are generally horizontally oriented and are disposed on opposite sides of said roof panel and a pair of said upper frame members which are spaced-apart from one another and disposed generally above the respective lower frame members, said window arrangement including a transparent window panel and a reinforcing frame surrounding said window panel, opposite sides of said reinforcing frame being slidably attached to the respective upper frame members such that said window arrangement extends between said upper frame members and is slidably movable therealong into the open position wherein said window arrangement is disposed beneath said roof panel and the closed position wherein said window arrangement projects forwardly from a forwardmost edge of said roof panel and gradually angles downwardly towards a front deck of said boat.

15. The combination of claim 14 wherein said frame includes a generally horizontal front frame member which extends transversely between front ends of said lower frame members, and a pair of generally vertically oriented rear frame members which project upwardly from rear ends of the respective lower frame members and supportingly engage said roof panel.

16. The combination of claim 15 wherein said frame includes a pair of side frame members having front ends which are fixed to the respective lower frame members rearwardly of said front frame member and rear ends which are fixed to the respective rear frame members adjacent upper ends thereof, and a grid-like roof support structure disposed between an upper rear edge portion of said window arrangement in the closed position thereof and a rearmost frame member which extends transversely between said upper ends of said rear frame members, said roof panel being disposed on said roof support structure.

17. The combination of claim 16 wherein said front frame member includes a first locking mechanism which cooperates with a lower front edge portion of said window arrangement to lock same in the closed position, and said roof support structure includes a second locking mechanism which cooperates with said upper rear edge portion of said window arrangement to lock same in the open position.

18. An awning assembly for a recreational boat having an open steering area, said awning assembly comprising:

a rigid frame including a pair of generally parallel and laterally-spaced elongate lower frame members and a pair of laterally-spaced elongate upper frame members disposed generally above the respective lower frame members and connected thereto;

a roof panel supported on a rear portion of said frame;

a window assembly supported on a front portion of said frame forwardly of said roof panel, said window assembly including a transparent window and a reinforcing frame disposed peripherally about and fixed to said window, said reinforcing frame being slidably mounted on said upper frame members to permit sliding movement of said window assembly into open and closed positions; and a connecting structure for removably connecting said lower frame members to the boat such that said awning assembly covers the open steering area thereof.

19. The awning assembly of claim 18 wherein forward ends of the respective lower frame members are connected to one another by a front frame member which extends transversely therebetween and is disposed adjacent a lower edge of said window assembly in the closed position thereof, and rearward ends of the respective lower frame members are joined to respective generally upright frame members which are generally parallel to one another and are joined at upper ends thereof by a transversely extending rear frame member, and each of said upper frame members has a rear end fixed to a said upright frame member and a front end connected to a front end portion of a said lower frame member.

20. The awning assembly of claim 19 wherein said frame includes a pair of side frame members disposed above the respective upper frame members, rear ends of said side frame members being fixed to upper end portions of the respective upright frame members and front ends of said side frame members respectively define vertically oriented portions, lower ends of said vertically oriented portions being fixed to the respective front end portions of said lower frame members, and said front ends of said upper frame members being fixed to the respective vertically oriented portions a short distance above said lower frame members.

* * * * *